US006164911A

United States Patent [19]

LeBlanc et al.

[11] Patent Number: 6,164,911

[45] Date of Patent: Dec. 26, 2000

[54] LOW ASPECT RATIO COMPRESSOR CASING TREATMENT

[75] Inventors: André Denis LeBlanc, St. Bruno; Gilbert Ouellet, Montreal, both of Canada

[73] Assignee: Pratt & Whitney Canada Corp., Longueuil, Canada

[21] Appl. No.: 09/258,286

[22] Filed: Feb. 26, 1999

[30] Foreign Application Priority Data

Nov. 13, 1998 [CA] Canada ..... 2254043

[51] Int. Cl.[7] ..... F01D 9/00

[52] U.S. Cl. ..... 415/228; 415/117; 415/914; 415/173.1; 416/181; 416/189

[58] Field of Search ..... 415/115, 116, 415/117, 228, 914, 173.1; 416/181, 185, 189

[56] References Cited

U.S. PATENT DOCUMENTS 3,887,295 6/1975 Yu ..... 415/116
3,893,787 7/1975 Jones .
4,063,848 12/1977 Wiggins et al. .
4,086,022 4/1978 Freeman et al. .
4,212,585 7/1980 Swarden et al. ..... 415/53 R
4,239,452 12/1980 Roberts, Jr. .
4,466,772 8/1984 Okapuu et al. .
4,540,335 9/1985 Yamaguchi et al. .
4,714,406 12/1987 Hough .
4,781,530 11/1988 Lauterbach et al. .
5,137,419 8/1992 Waterman .
5,256,031 10/1993 Bothien et al. .
5,277,541 1/1994 Palmer .
5,308,225 5/1994 Koff et al. .
5,466,118 11/1995 Heinrich ..... 415/58.6
5,520,508 5/1996 Khalid .
5,707,206 1/1998 Goto et al. .

*Primary Examiner*—F. Daniel Lopez
*Assistant Examiner*—Ninh Nguyen
*Attorney, Agent, or Firm*—Jeffrey W. Astle

[57] ABSTRACT

A compressor for a gas turbine engine, comprising a casing having an inner surface defining a plurality of circumferentially spaced-apart grooves adjacent the tips of a row of rotor blades. Each groove as a depth which is less than half the width thereof in order to increase surge margin at off design points without affecting the performance of the compressor under normal operating conditions.

9 Claims, 2 Drawing Sheets

LOW ASPECT RATIO COMPRESSOR CASING TREATMENT

BACKGROUND OF THE INVENTION

1. Field of the Invention

The present invention relates to turbine engines and, more particularly, pertains to axial and centrifugal compressors for such engines.

2. Description of the Prior Art

Compressors are used in gas turbine engines to compress and direct pressurized gas, such as air, to a combustion section of a gas turbine engine. Such compressors generally comprise a rotor assembly, carrying a number of radially extending blades, mounted on an axis for rotation within a stationary casing or shroud. The rotation of the rotor assembly causes the gas to be drawn into the rotor assembly and to be discharged at high pressure to the combustion section of the gas turbine engine.

It is a characteristic, common to such compressors, to surge under certain operating conditions. Typically, surge results from unstable air flow condition within the compressor. Compressor surge is generally characterized by a complete flow breakdown or flow reversal through the compressor, or by a sharp reduction of the airflow handling ability of the engine for its operating rotational speed. The value of airflow and pressure ratio at which a surge occurs is referred to as surge point. The surge line, which joins all the surge points, defines the maximum stable airflow which can be obtained at any rotational speed. A compressor must be designed to have a good safety margin between the airflow and pressure ratio at which it will be operated and the airflow and pressure ratio at which a surge will occur.

Accordingly, various attempts have been made to increase the surge margin under all operating conditions. For instance, U.S. Pat. No. 4,086,022 issued on Apr. 25, 1978 to Freeman et al. and U.S. Pat. No. 5,137,419 issued on Aug. 11, 1992 to Waterman both disclose a compressor casing having an inner surface defining a plurality of circumferentially spaced-apart slots adjacent the tips of a row of rotor blades. The slots are sized and positioned such as to extend in part upstream or downstream of the blades.

Although the compressor casings described in the above mentioned patents are effective for improving surge margin, they induce relatively a large radial displacement of gas flow which results in pressure loss.

SUMMARY OF THE INVENTION

It is therefore an aim of the present invention to provide a compressor which is adapted to improve surge margin under normal operating conditions.

It is also an aim of the present invention to provide a compressor which is adapted to generally improve airflow characteristics.

It is a further aim of the present invention to provide a compressor shroud treatment adapted to improve surge margin.

Therefore, in accordance with the present invention there is provided a compressor for a gas turbine engine, comprising a shroud surrounding a rotor assembly having a plurality of radially extending blades, each blade having leading and trailing edges and a tip, said shroud having an inner surface defining a plurality of circumferentially distributed parallel grooves adjacent said tips, each said groove having a depth D and a width W, said depth D being less than half said width W.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
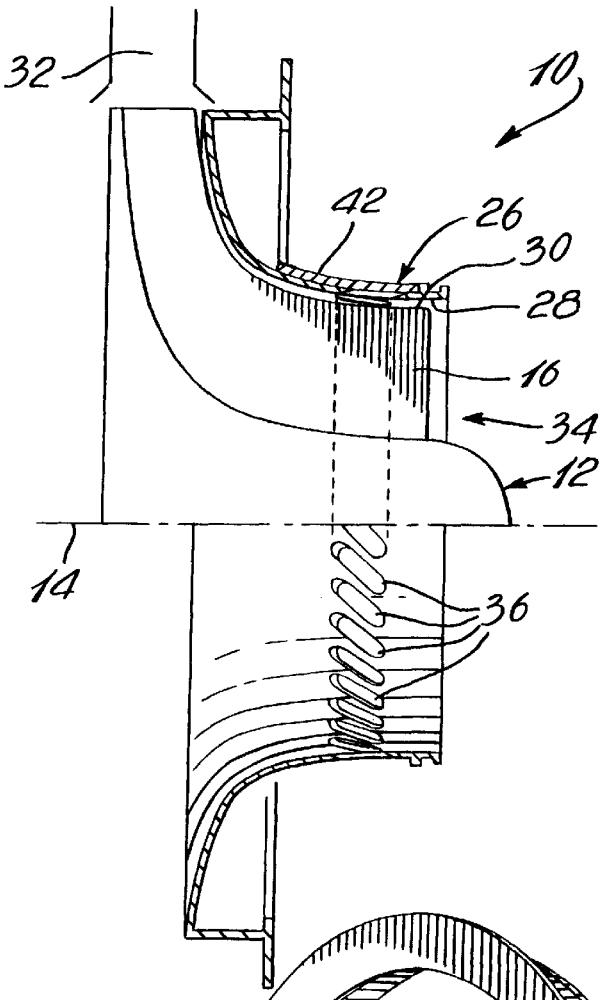
FIG. 1 is a schematical longitudinal cross-sectional view of a compressor section of a gas turbine engine having a shroud in accordance with the present invention.
Figure 2:
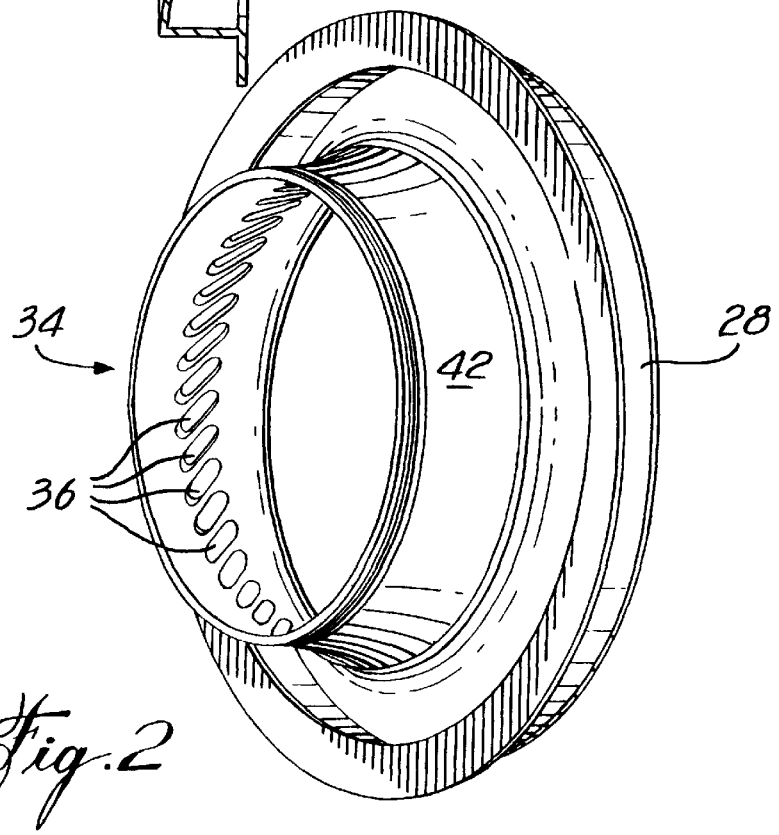
FIG. 2 is a perspective view of the shroud.

Now referring to the drawings, and in particular to FIG. 1, a centrifugal compressor 10 embodying the elements of the present invention will be described.

Figure 4:
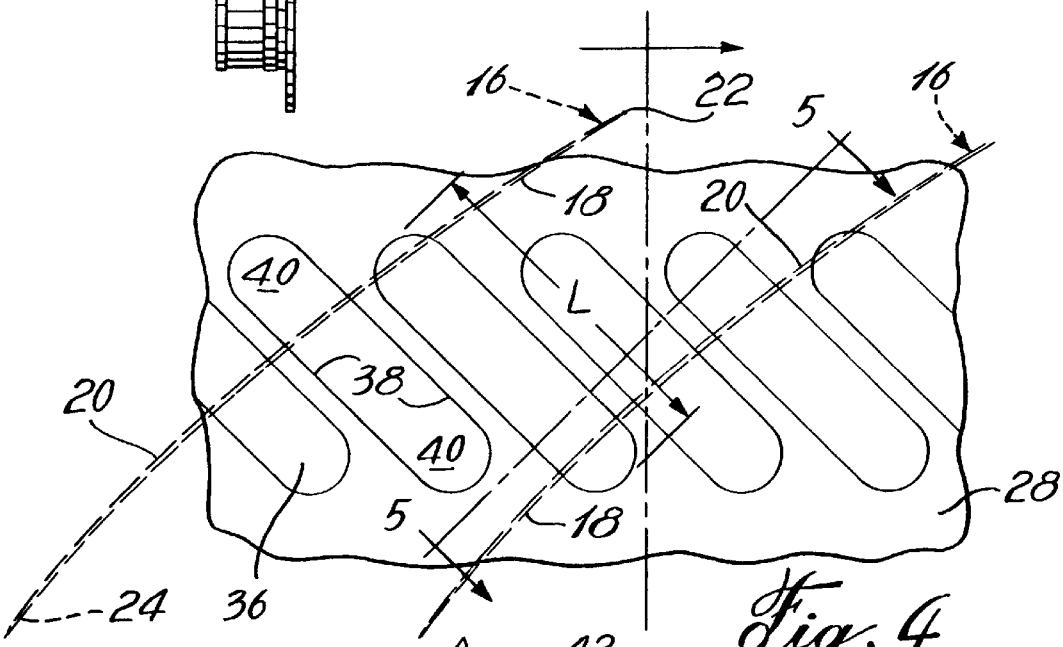
FIG. 4 is a fragmentary plan view of the radial inner surface of the shroud.

More specifically, the centrifugal compressor 10 comprises an impeller 12 mounted for rotation about a central axis 14, as is well known in the art. The impeller 12 is provided with a plurality of radially extending blades 16. As seen in FIG. 4, each blade 16 has a high pressure or concave side 18 and a low pressure or convex side 20 extending from a leading edge 22 to a trailing edge 24. The centrifugal compressor 10 further comprises a casing 26 including a stationary cylindrical shroud 28 disposed adjacent the radial outer ends or tips 30 of the blades 16. A diffusion section 32 is provided at the exit of the impeller 12.

Figure 5:
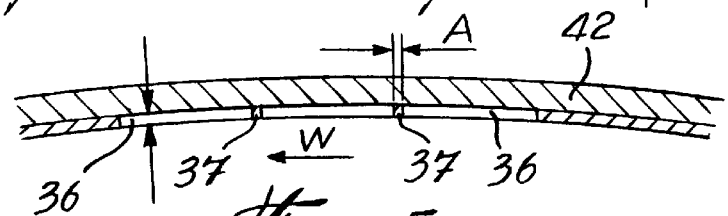
FIG. 5 is a cross-sectional view taken along line 5—5 of FIG. 4.

According to the present invention, the shroud 28 is provided, at an inducer section 34, with a plurality of regularly circumferentially spaced-apart parallel grooves 36. As seen in FIGS. 4 and 5, each groove has a depth D, a width W and a length L and is shaped and positioned such as not to extend beyond the trailing and leading edges 22 and 24 of the blades 16. The grooves 36 have relatively long straight side edges 38 and opposed semi-circular end portions 40.

It has been found that the depth D of the grooves 36 should be less than half the width W thereof to provide surge margin improvement without affecting the overall compressor efficiency. Furthermore, by having a ratio D/W less than 0.5, there is a continuous flow of gas passing in the grooves 36 during operation of the compressor 10 thereby preventing the accumulation of dirt within the grooves 36 and thus ensuring substantially constant performance of the compressor 10. For instance, tests have shown that improved results in surge margin can be obtained by having a ratio D/W extending in a range of about 0.15 to about 0.35. According to a typical construction of the present invention, the dimensions of the grooves 36 are as follows:

D=0.075 inch

W=0.225 inch

L=0.410 inch

As seen in FIGS. 4 and 5, adjacent grooves 36 are separated by a land 37 which is the portion of the shroud wall which joins two grooves 36. It would also appear that improvements in surge margin will be obtained if the distance between the grooves 36, i.e. the width A of the land 37, is equal or smaller than the depth D of the grooves 36. Typically, the land widths A should be in a range extending from about 0.06 inch to about 0.08 inch.

Figure 3:
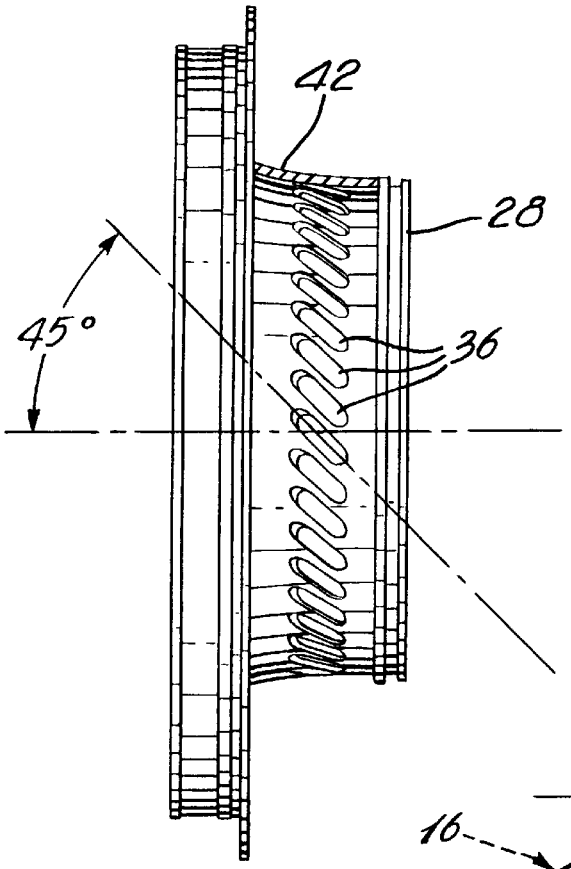
FIG. 3 is an elevational side view of the shroud.

As seen in FIGS. 3 and 4, the grooves 36 are oriented normal, ±15°, to the mean angle of the blade length and extend at approximately 45° to the central axis 14 of the centrifugal compressor 10. It is noted that each individual blade 16 should extend over at least three grooves 36 at all time.

In operation, the gas on the high pressure sides 18 of the blades 16 migrates to the low pressure sides 20 thereof. The high pressure gas energizes the low pressure gas on the low pressure side 20 of the blades 16, thereby delaying stall at off design operating conditions. The parameters of the grooves 36, i.e. the length L, the width W, the depth D and the angular position thereof, allows sufficient flow to increase stall margin through out the operating speed range. The grooves 36 provide, continuously, high energy gas to the low pressure side 20 over the desired blade length. As a result, tip stall is delayed and blade pumping capacity is improved thereby increasing the efficiency of the compressor 10 at off design operating conditions. At design operating conditions, the grooves 36 generate minimum flow perturbation by minimizing the radial component of the gas flow velocity. Loss associated with the introduction of a radial component in velocity is thus minimized. By optimizing the flow direction with groove orientation and minimizing the quantity diverted with groove depth, the amount of secondary flow is kept to a minimum, resulting in little or no performance loss at the design point operating conditions.

In addition to the advantages mentioned above, broad band noise is simultaneously reduced. Furthermore, the grooves 36 desensitized the change in performance as a function of radial blade tip clearance (the gap between the tips of the blades 36 and the inner surface of the shroud 28). Indeed, a small increase in blade tip clearance of a few thousands of an inch represents a small percentage increase in radial gap compared to the depth D of the grooves 36.

According to one embodiment of the present invention, the circumferentially spaced-apart grooves 36 are machined through the shroud 28 and subsequently covered by a liner 42 welded to the outer surface of the shroud 28, as seen in FIG. 3. The liner 42 thus forms the bottom surface of each groove 36.

Although the present invention has been described in the context of a centrifugal compressor, it is noted that the above low aspect casing treatment was applied successfully to an axial flow compressor.

What is claimed is:

1. A compressor for a gas turbine engine, comprising a shroud surrounding a rotor assembly having a plurality of radially extending blades, each blade having leading and trailing edges and a tip, said shroud having an inner surface defining a plurality of circumferentially distributed parallel grooves adjacent said tips for allowing air to flow locally over said tips of said blades from high pressure to low pressure sides thereof, each said groove having a depth D in a radial direction, a length L, and a width W, said depth D being less than half said width W along all said length.

2. A compressor as defined in claim 1, wherein each said groove has opposed leading and trailing ends, said leading end being disposed substantially downstream of said leading edges of said blades, whereas said trailing end is disposed substantially upstream of said trailing edges of said blades.

3. A compressor as defined in claim 1, wherein D/W is comprised in a range extending from about 0.15 to about 0.35.

4. A compressor as defined in claim 1, wherein said grooves are generally normal, ±15°, to said blades.

5. A compressor as defined in claim 4, wherein said grooves extend at about 45° to a longitudinal axis of said compressor.

6. A compressor as defined in claim 1, wherein the distance A between said grooves is equal or less than D.

7. A compressor as defined in claim 1, wherein each said groove has a pair of straight elongated side walls and a bottom wall.

8. A compressor as defined in claim 7, wherein each said groove has opposed, closed, semi-circular end portions.

9. A compressor as defined in claim 1, wherein each said blade extends over at least three grooves at all time.

* * * * *